US005770798A

United States Patent [19]

Georgi et al.

[11] Patent Number: 5,770,798

[45] Date of Patent: Jun. 23, 1998

[54] VARIABLE DIAMETER PROBE FOR DETECTING FORMATION DAMAGE

[75] Inventors: Daniel T. Georgi; John M. Michaels, both of Houston; Michael J. Moody, Katy, all of Tex.

[73] Assignee: Western Atlas International, Inc., Houston, Tex.

[21] Appl. No.: 599,337

[22] Filed: Feb. 9, 1996

[51] Int. Cl.[6] ..... E21B 49/00

[52] U.S. Cl. ..... 73/152.05

[58] Field of Search ..... 73/37, 38, 151, 73/152.02, 152.05, 152.17, 152.22, 152.24, 152.26, 152.39

[56] References Cited

U.S. PATENT DOCUMENTS

| | | | |
|---|---|---|---|
| 2,747,401 | 4/1956 | Doll | 73/151 |
| 3,035,440 | 4/1962 | Reed | 73/151 |
| 3,385,364 | 5/1968 | Whitten | 166/100 |
| 3,565,170 | 2/1971 | Urbanosky | 166/100 |
| 4,742,459 | 5/1988 | Lasseter | 73/151 X |
| 4,864,845 | 9/1989 | Chandler et al. | 73/38 |
| 4,890,487 | 1/1990 | Dussan et al. | 73/152 |
| 4,893,505 | 1/1990 | Marsden et al. | 73/155 |
| 5,303,775 | 4/1994 | Michaels et al. | 166/264 |
| 5,377,755 | 1/1995 | Michaels et al. | 166/264 |
| 5,473,939 | 12/1995 | Leder et al. | 73/155 |

FOREIGN PATENT DOCUMENTS 0520903 10/1995 European Pat. Off. .

OTHER PUBLICATIONS

Goggin, D.J., Thrasher, R.L., Lake, L.W., A Theoretical and Experimental Analysis of Minipermeameter Response Including Gas Slippage and High Velocity Flow Effects, In Situ, 12 (1&2), 79–116 (1988).

*Primary Examiner*—Hezron E. Williams
*Assistant Examiner*—Jay L. Politzer
*Attorney, Agent, or Firm*—Alan J. Atkinson

[57] ABSTRACT

An apparatus and method for evaluating formation damage proximate to the surface of a rock. The invention is applicable to surface tests and to tests downhole in a borehole. A first hollow probe sealingly contacts the rock surface to define a first surface area, and the pressure within the hollow probe is decreased to monitor resulting pressure changes. A second hollow probe contacts the rock surface to define a second surface area having a different size than the first surface area, and the pressure within the hollow second probe is decreased to monitor resulting pressure changes. Differences in the observed pressure changes can be analyzed to evaluate formation damage to the rock surface and near surface. In particular, the thickness of formation damage, and permeability losses caused by such damage, can be assessed. Alternatively, fluid pressure can be injected into the first and second volumes to evaluate the subsequent pressure reduction.

28 Claims, 3 Drawing Sheets

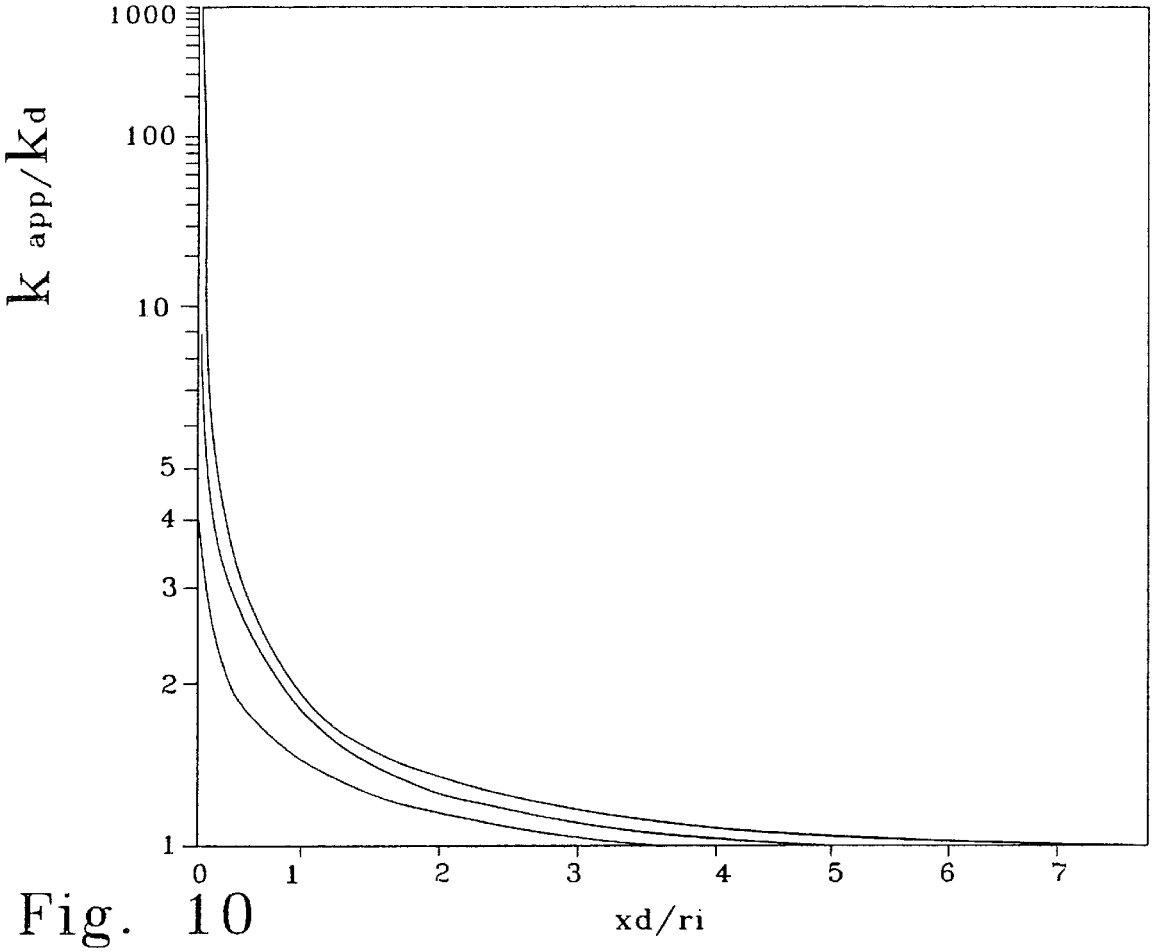
Fig. 10
Fig. 11
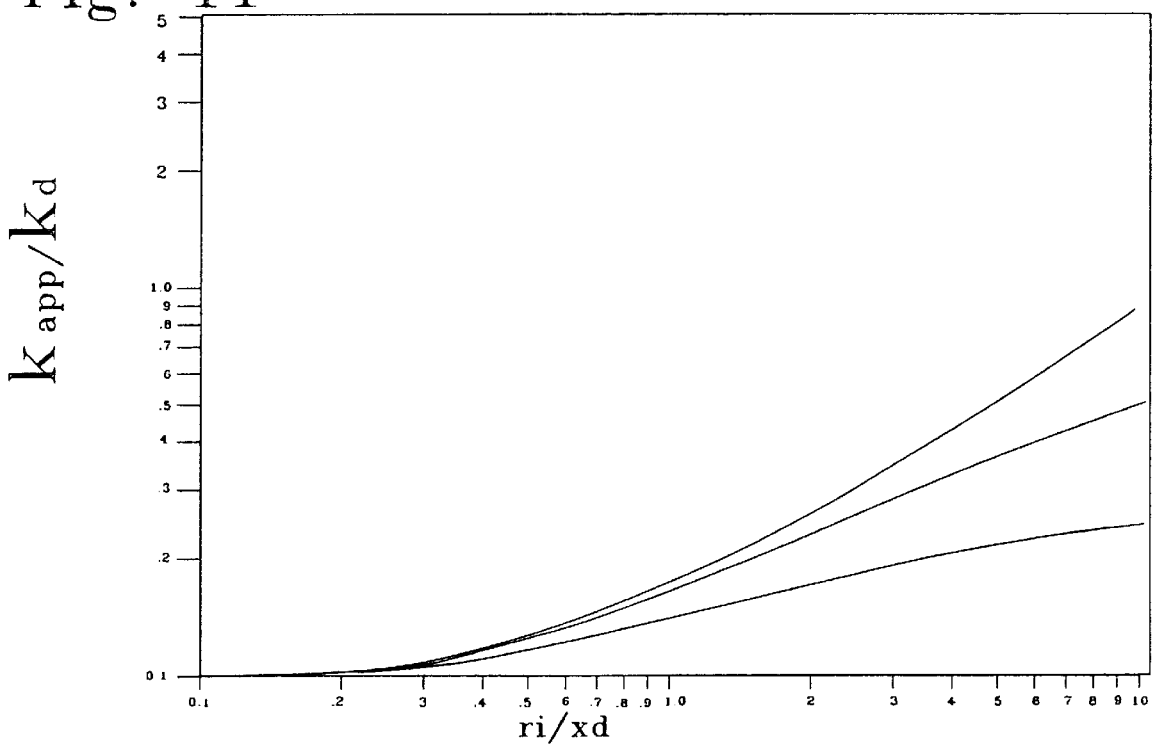

VARIABLE DIAMETER PROBE FOR DETECTING FORMATION DAMAGE

BACKGROUND OF THE INVENTION

The present invention relates to the field of formation damage detection. More particularly, the present invention relates to an apparatus and method for detecting damage proximate to a rock surface.

Drilling and well completion operations frequently damage the rock wall surface in a wellbore. Such damage can permanently reduce the ability of a hydrocarbon reservoir to produce fluids into the wellbore, or to accept fluids injected from the wellbore into the formation. Horizontal wells are particularly susceptible to formation damage, and relatively slight damage can significantly reduce rock permeability in a horizontal well.

If rock core samples are available, laboratory analysis of possible rock formation damage can be performed before drilling and completion operations begin. Laboratory analysis can suggest specifications for the mud type, overbalance pressure, solids content and size distribution, bridging agents, and chemical absorption agents.

If core samples are unavailable, rock formation damage can be tested during drilling and completion operations to evaluate the effectiveness of existing drilling and completion procedures. The failure to prevent formation damage can irrevocably damage the rock surface of a borehole, and the failure to accurately identify rock formation damage can result in the abandonment of an economic producing zone.

Formation damage in a well is caused by different factors. Formation damage can occur due to mechanical fracture of the rock surface. In addition, drilling operations circulate a drilling mud to lubricate the drill bit and to form a "mud cake" on the borehole wall surface. The mud cake prevents filtrate loss, reduces the drilling mud volume, and prevents undesirable loss of circulation. The mud cake is created by weighting a drilling mud so that the hydrostatic drilling mud pressure exceeds the formation fluid pressure. Drilling mud clay particles damage the formation by plugging pore spaces at the interface between the borehole wall surface and the formation rock. Although most of the mud cake can be removed, clay particles trapped in the reservoir pore space reduce the permeability of the formation.

In addition to invasive damage caused by drilling mud, the liberation of small particles known as "fines" can bridge pore throats and reduce permeability. The fines can originate from the drilling fluid, can be released from the formation, can be precipitated from the formation fluids, or can originate in the formation connate fluids. Moreover, asphaltene particles can precipitate during production of a reservoir to reduce formation permeability.

In addition to formation damage associated with mud solids invasion and fines blockage, formation damage can also occur because of relative permeability effects and formation swelling. When water based drilling mud contacts an oil bearing reservoir rock, the resulting contact may reduce the effective formation permeability below the absolute permeability for a single phase. Moreover, multi-phase flow can occur if the formation fluid drawdown rate reduces the pressure below the bubble point. Additionally, drilling muds can cause swelling in clay formations which close the interstitial pore spaces and reduce formation permeability.

Formation damage is typically limited to the region near the wellbore rock surface. Wireline testing tools measure formation pressure and the pressure transient. From this information, a reservoir pressure profile and the formation permeability can be derived. To perform wireline tests, a tool is lowered into the borehole to the desired location, and a packer is set against the formation. The pressure inside the packer is lowered below the formation pressure, and the formation pressure moves the mud cake from contact with the borehole wall. Such pressure is further reduced so that reservoir fluid flows from the permeable formation to build pressure within the tool. The apparent permeability of the formation is determined by measuring pressure versus the time for the pressure to drawdown from the reservoir pressure. Alternatively, the apparent permeability is determined by injecting a fluid into the formation, and by measuring the reduction in the injected pressure. After either test is performed the packer is retracted and the the test sequence can be repeated at another location in the wellbore.

Representative examples of downhole formation test procedures are disclosed in U.S. Pat. No. 5,377,755 to Michaels et al.(1995), in U.S. Pat. No. 5,303,775 to Michaels et al.(1994), and in U.S. Pat. No. 5,473,939 to Leder et al.(1995). These procedures capture connate fluid for transportation from a subsurface formation to the well surface. In addition to downhole testing procedures which draw fluids from a reservoir or laboratory core sample, permeameters measure permeability of a rock sample by injecting a fluid into a rock and by measuring the pressure drop in the sample charge. One example of a portable permeameter is disclosed in U.S. Pat. No. 4,864,845 to Chandler et al. (1989).

Conventional wireline formation testers incorporate a packer having a central port for contacting the borehole wall surface. The shape of the port opening in contact with the rock surface defines a geometric factor relevant to interpreting the measured pressure transient data. The apparent drawdown permeability of the formation can be calculated from such data.

Darcy's law for steady-state incompressible radial flow generally describes the permeability of an undamaged, homogeous and isotropic medium. In a paper by Goggin et al. entitled "A Theoretical and Experimental Analysis of Minipermeameter Response Including Gas Slippage and High Velocity Flow Effects," In Situ (1988), a geometrical factor ($G_0$) was introduced into a modified form of Darcy's law to compute permeability from steady state measurements of gas flow rate and injection pressure. Goggin et al. further concluded that the effective depth of investigation for a probe is approximately four times the internal tip-seal radius. Consequently, a probe having an internal tip-seal radius of 0.25 cm would have a corresponding investigation depth of 1.00 cm beyond the rock surface.

Conventional well testing procedures do not provide information regarding formation damage. In particular, wireline formation tests do not provide any measure of the depth and extent of damage beyond the rock surface. Accordingly, a need exists for an apparatus and method for assessing rock formation damage. In particular, a need exists for an apparatus and method that can assess formation damage in real time before well casing or other well completion operations are performed.

SUMMARY OF THE INVENTION

The present invention provides an apparatus and method for evaluating damage proximate to a rock surface. The apparatus generally comprises a housing, a first probe having a hollow contact end for sealing engagement with the rock to enclose a first interior volume and to define a first surface area on the rock surface, a second probe having a hollow contact end for sealing engagement with the rock to define a second surface area smaller than the first surface area, a pressure changing device for selectively changing the pressure within the first interior volume and the second interior volume, and a sensor for monitoring changes within the first interior volume and the second interior volume.

In alternative embodiments of the invention, the second and first probes can define circular and concentric first and second surface areas. The sensor can detect pressure increases and decreases within the first and second volumes, and the relative size, orientation and location of multiple probes can be selected to obtain different information from the rock surface.

The method of the invention is practiced by positioning the housing proximate to the rock surface, by moving a first probe into sealing contact with the rock surface to define a first interior volume and a first surface area, by selectively changing the pressure and by monitoring pressure changes within the first interior volume, by moving a second probe into sealing contact with the rock surface to define a second interior volume and a second surface area smaller than the first surface area, by changing the pressure within the second interior volume, and by operating a sensor to monitor pressure changes in the first and second interior volumes.

BRIEF DESCRIPTION OF THE DRAWINGS

FIG. 10 illustates a graph indicating the relationship of undamaged to damaged permeability ratio to the ratio of damaged zone thickness to probe diameter.

FIG. 11 illustrates a graph indicating the apparent permeability relative to damaged permeability near a borehole, versus the damaged zone thickness relative to the inside packer radius.

DESCRIPTION OF THE PREFERRED EMBODIMENTS

Figure 1:
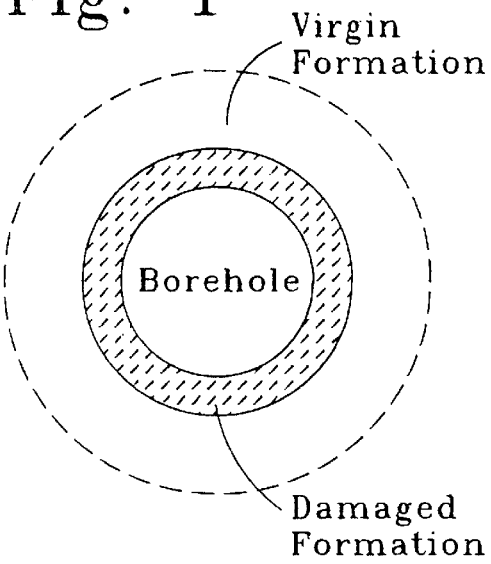
FIG. 1 illustrates a schematic plan view of formation damage proximate to the wall surface of a borehole.
Figure 2:
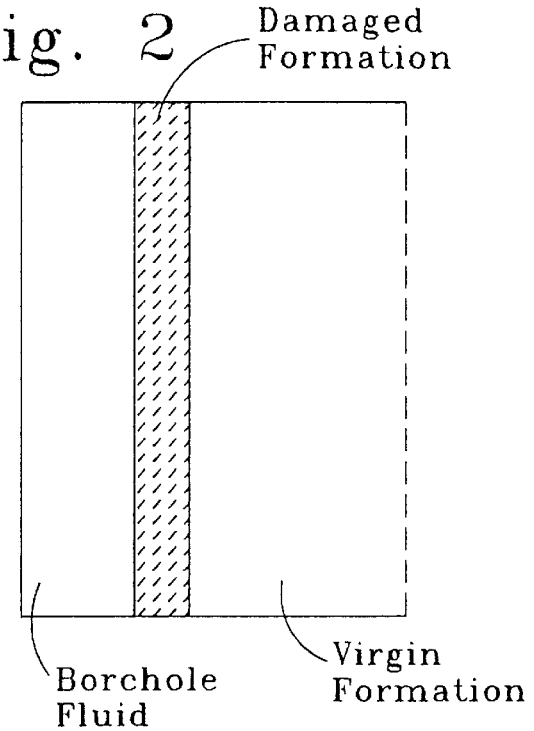
FIG. 2 illustrates a schematic elevation view of formation damage proximate to the wall surface of a borehole.

The present invention provides an apparatus and method for evaluating damage near a rock surface. The invention is applicable to rock surfaces at ground level or downhole in a borehole. FIG. 1 illustrates a plan view of formation damage near the rock surface in a wellbore. FIG. 2 illustrates an elevation view of formation damage near the rock surface in a wellbore.

Figure 3:
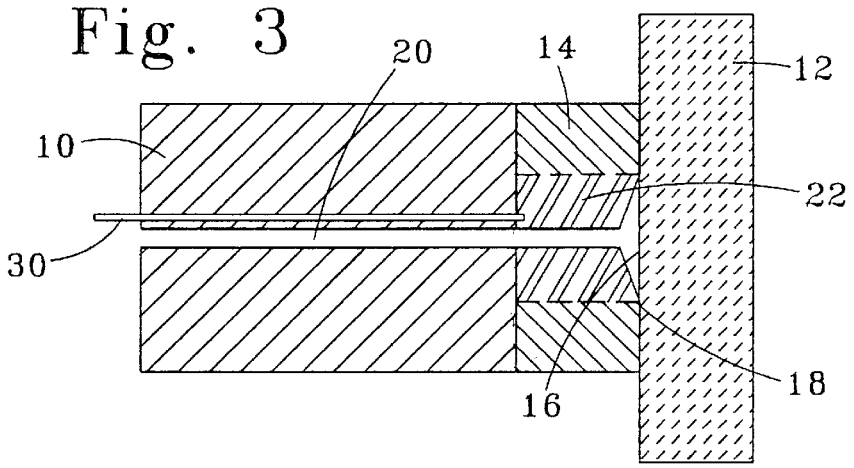
FIG. 3 illustrates a schematic view of a first probe in contact with a rock surface.

FIG. 3 illustrates a schematic drawing for one embodiment of the invention. Tool housing 10 is positioned proximate to the surface of rock 12, and fixed packer element 14 contacts rock 12. Fixed packer element 14 comprises a hollow probe or packer-snorkle for contacting rock 12. Fixed packer element 14 can be rigid or can be inflatable. Fixed packer element 14 isolates a first surface area 16 on the surface of rock 12 having a perimeter defined by the interior contact line 18 between fixed packer element 14 and rock 12. Fixed packer element 14 also encloses a first interior volume 20 defined by the interior surface of fixed packer element 14, first surface area 16, and the interior of housing 10.

Figure 4:
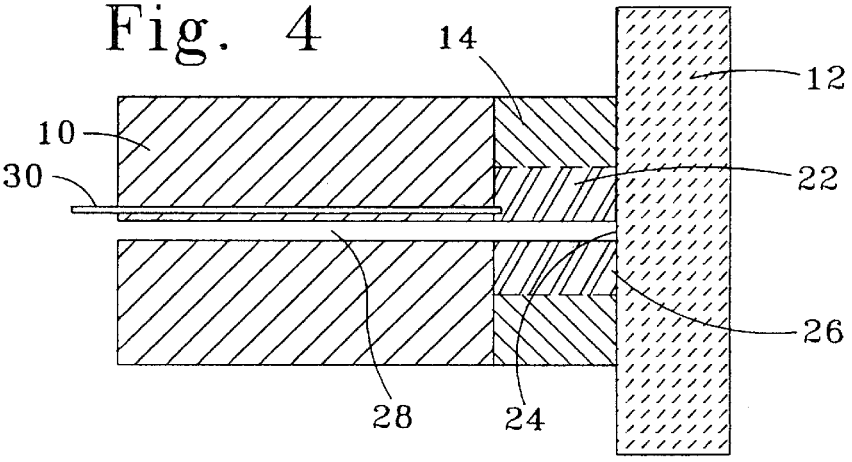
FIG. 4 illustrates a schematic view of a second probe in contact with a rock surface.

FIG. 4 illustrates the function of inflatable packer element 22 engaged between housing 10 and rock 12. Inflatable packer element 22 is initially deflated as shown in FIG. 3 and is inflatable to contact rock 12. Such contact defines a second surface area 24 bounded by interior contact line 26, and second surface area 24 is smaller than first surface area 16. Inflatable packer element 22 comprises a hollow probe for contacting rock 12. Inflatable packer element 22 also cooperates with second surface area 24 and the interior of housing 10 to define second interior volume 28. Inflatable packer element 22 can be inflated with a gas or other fluid directed through aperture 30.

Fixed packer element 14 and inflatable packer element 22 must hold an effective seal against rock 12 to provide credible pressure change measurements. If desired, opposing pistons (not shown) can operate on the opposite side of housing 10 to stabilize housing 10 downhole in a borehole.

Although first surface area 16 and second surface area 24 are shown as concentric circular areas, the geometry and placement of each surface area can be modified by the shape and orientation of the interior dimensions of fixed packer element 14 and of inflatable packer element 22. The circumferences defined by interior contact line 18 and interior contact line 26 can be circular, rectangular, oblique, trapezoidal, irregular, or any other selected shape. Although second surface area 24 is shown as being coincident with first surface area 16, second surface area 24 could be positioned to contact rock 12 at any other selected position outside of the plane segment defined by first surface area 24. If second surface 24 is coincident with first surface area 16, the exterior seal provided by fixed packer element 14 provides a primary barrier against wellbore fluids. Additionally, the initial reduction of pressure within first interior volume 20 removes the mud cake coating both rock surfaces identified as first surface area 16 amd second surface area 24.

Figure 5:
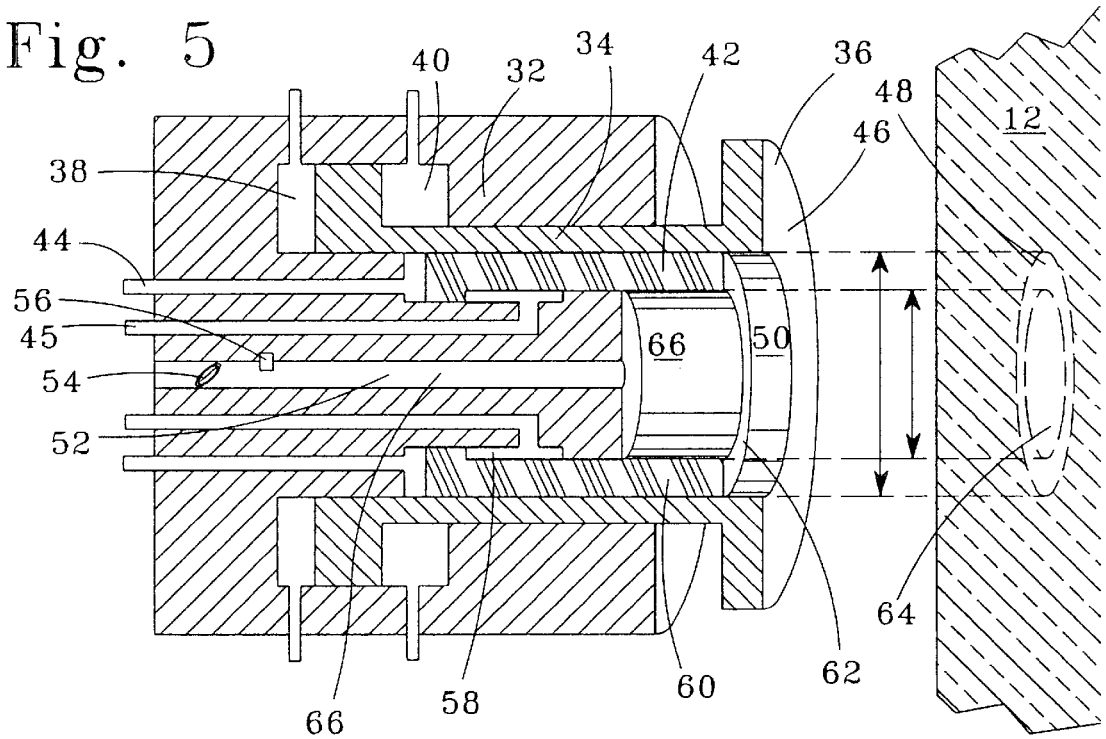
FIG. 5 illustrates a sectional view for one embodiment of an apparatus having first and second probes.

FIG. 5 illustrates one configuration of the invention. Housing 32 can be positioned proximate to rock 12 in a laboratory setting or can be lowered by a wireline into a wellbore. Packer cylinder 34 comprises a double acting piston radially movable relative to housing 32 and is attached to packer 36. When fluid is pumped into annulus 38, cylinder 34 moves radially outwardly toward rock 12 until packer 36 contacts rock 12 with the desired force. Cylinder 34 can be retracted by reducing fluid pressure in annulus 38 while increasing the fluid pressure in annulus 40.

Similarly, cylinder 42 is selectively movable toward rock 12 by increasing the pressure within aperture 44, and is selectively retractable by reducing the pressure within aperture 44 while increasing the pressure within aperture 45.

When packer 36 contacts rock 12, the interior contact line between packer 36 and rock 12 defines the circumference of a plane segment on rock 12 identified as first surface area 48. First interior volume 50 is defined by the interior of packer 36, first surface area 48, the exposed interior volume of cylinder 42, and the interior of drawdown line 52. After first surface area 48 is isolated by packer 36, the pressure within drawdown line 52 is reduced by a pump or other device (not shown) positioned within housing 32 or located at the well surface. The pressure can be reduced with a positive displacement pump, by opening a valve 54 to increase the effective volume, or by other techniques sufficient to create a pressure gradient and the resulting fluid flow.

In a wellbore, when the pressure within first interior volume 50 is reduced below the pressure within rock 12, mud cake on the surface of rock 12 is pushed from rock 12 and flows into first interior volume 50. In a surface test apparatus or in a downhole injection test, the pressure within first interior volume 50 will stabilize when such pressure equals the pressure injected into rock 12 from a test apparatus (not shown). Valve 54 can be closed to isolate first interior volume 50 from the pump, and the pressure within first interior volume 50 will continue to build until such pressure equalizes with the pressure within rock 12.

During this process, sensor 56 detects the pressure rate increases and the ultimate pressure increase within first interior volume 50. As known in the art, the rate of pressure increase can indicate apparent permeability of rock 12. However, such pressure rate may not accurately indicate absolute permeability due to damage near the surface of rock 12.

After pressure data for first interior volume 50 is recorded, fluid is pumped into annulus 44 to move second cylinder 42 radially outwardly from housing 32. Second cylinder 42 has end 62 for contacting rock 12 and for isolating second surface area 64 on the surface of rock 12. Second interior volume 66 is defined by the interior of second cylinder 42, by second surface area 64, and by the interior of drawdown line 52. After end 62 contacts rock 12 with the desired force to pressure isolate second surface area 64, the pressure within second interior volume 66 is reduced with the pump or other pressure changing device as previously described for first interior volume 50. Valve 54 can be closed, and the pressure buildup rate and final pressure within second interior volume 66 is monitored with sensor 56.

Drawdown permeabilities are routinely calculated from the pressure transient data collected in oil field units with wireline formation testers. The drawdown permeability is calculated as:

$$k_d = 1842 \cdot C \cdot \frac{q \cdot \mu}{d_i \cdot (p' - p'^*)} \tag{1}$$

where:

C=flow shape factor (generally 1.0)

$k_d$=drawdown permeability [md]

q=flow rate [$cm^3/s$]

$d_i$=diameter of snorkle [in.]

p'=pressure at snorkle [psi]

p'*=reservoir pressure [psi].

Figure 6:
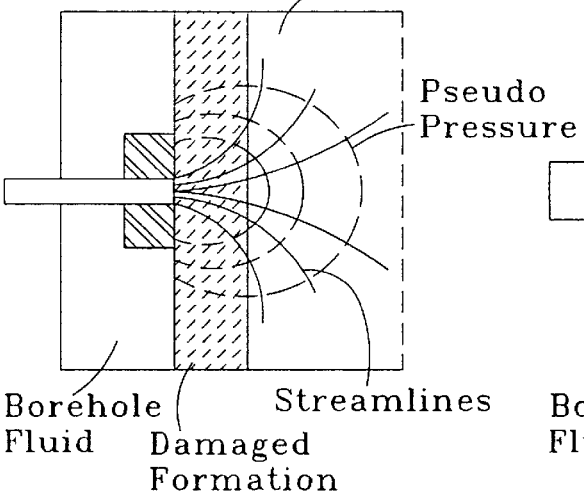
FIG. 6 illustrates a schematic view of isobars and streamlines for a small diameter probe during a pressure test.
Figure 7:
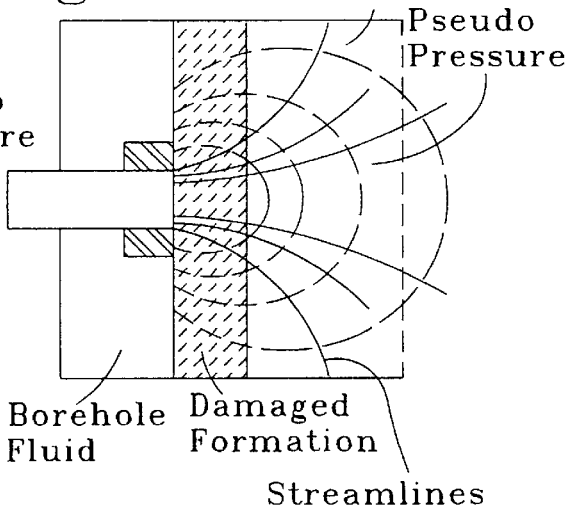
FIG. 7 illustrates a schematic view of isobars and streamlines for a large diameter probe during a pressure test.

The effective depth of investigation for a drawdown procedure is controlled by several factors including the amplitude of the pressure drawdown and the inner radius of the packer-snorkle assembly. By performing at least two tests having different internal diameters, the invention permits the calculation of different rock characteristics. For example, the pressure transient data from multiple tests with differing parameters can be compared to determine the presence of thin layer formation damage, the thickness of the damaged layer, the permeability of the damaged layer, and the permeability of the undamaged rock. FIGS. 6 and 7 illustrate schematic view of the investigation range detected by packer-snorkles having different internal diameters.

Figure 8:
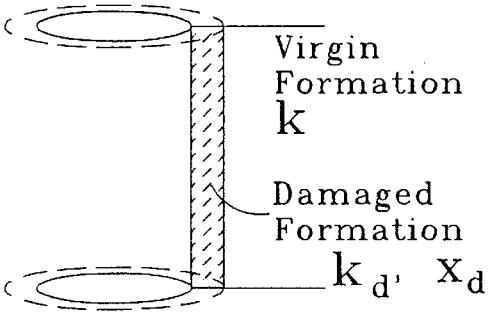
FIG. 8 illustrates axial distribution of formation damage.
Figure 9:
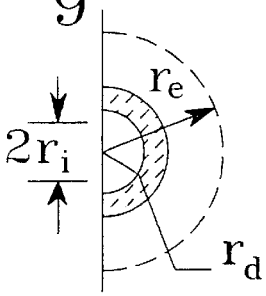
FIG. 9 illustrates a spherical model for a simple analytical model.

The relationship between the apparent "homogeneous" permeability of the rock and the packer diameter and depth of investigation can be illustrated. FIG. 8 illustrates a cylindrical model for a borehole, and FIG. 9 illustrates a hemispherical model for the borehole. Darcy's Law for the hemispherical system illustrated in FIG. 9 would be represented by the following equation if no damaged zone existed in rock 12:

$$k = \frac{q\mu\left(\frac{1}{r_i} - \frac{1}{r_e}\right)}{2\pi(p_e - p_i)} \tag{2}$$

where:

$r_i$=inner diameter of the packer-snorkle $r_d$=damaged zone thickness $r_e$=radius to the undamaged reservoir boundary q=flow rate $P_e$=pressure in undamaged formation, "P*"

$P_i$=pressure at the packer-snorkle.

However, with a damaged zone of permeability $k_d$, extending from internal radius $r_i$ to $r_d$ and the undamaged zone of permeability extending from $r_d$ to $r_e$, the volumetric flow rate q through the hemispherical surface area at any radius r is the same for all r. Therefore, from Equation (1) the total pressure drop in the two zones is:

$$p_e - p_i = \frac{q\mu}{2\pi}\left[\frac{\left(\frac{1}{r_i} - \frac{1}{r_d}\right)}{k_d} + \frac{\left(\frac{1}{r_d} - \frac{1}{r_e}\right)}{k}\right] \tag{3}$$

and the apparent permeability $k_{app}$ based on the interpretation of the pressure observed at the packer is obtained by substituting this result into Equation (1) as follows:

$$k_{app.} = \frac{\left(\frac{1}{r_i} - \frac{1}{r_e}\right)}{\frac{\left(\frac{1}{r_i} - \frac{1}{r_d}\right)}{k_d} + \frac{\left(\frac{1}{r_d} - \frac{1}{r_e}\right)}{k}} \tag{4}$$

If $r_e$ goes to infinity, the result can be rearranged as follows:

$$\frac{k_{app.}}{k_d} = \left[1 - \frac{r_i}{r_d} + \left(\frac{r_i}{r_d}\right)\left(\frac{k_d}{k}\right)\right]^{-1} \tag{5}$$

Values of $k_{app}/k_d$ calculated from Eq. 5 are plotted against $x_d/r_i$ (where $x_d=r_d-r_i$) in FIG. 10. These values were calculated for undamaged to damaged permeability ratios of 10, 100, and 1000. The left hand curve of FIG. 10 represents a packer-snorkle radius, and a hypothetical hemispherical cavity radius equal to the radius of the damaged zone (so that observed permeability is of the undamaged zone). The curve for the 1000 permeability ratio is at infinity at such point. As the packer-snorkle radius and hypothetical cavity radius become smaller with respect to the radius of the damaged zone, the difference between the 10 and 1000 permeability ratios narrows until the $x_d/r_i$ ratio is four. At such ratio, the apparent permeability of the damaged zone is only slightly higher than that of the damaged zone.

FIG. 11 shows the same data in a log—log plot form, except that the abscissa of FIG. 11 is the reciprocal of FIG. 10. If the magnitude of $x_d$ were generally known, three different packer-snorkle internal diameters of 0.5, 4.0, and 20.0 times the damaged zone thickness (with respective $r_i/x_d$ values of 0.25, 2.0, and 10.0) could yield approximate values for k, $k_d$, and $x_d$.

By using the relationships expressed above, the present invention permits certain information to be identified by correlating results obtained from packer-snorkles having differing internal diameters. The depth of investigation of a packer-snorkle is approximately four times the inner radius of the packer-snorkle contact with the rock. In a homogeneous formation having no formation damage, the ratio of $k_{app}$ for two different $r_i$'s would be equal to 1 as shown by the following example:

$$k = \frac{k_d}{1 - \frac{r_{i_small}}{r_d} + \left(\frac{r_{i_small}}{r_d}\right)\left(\frac{k_d}{k}\right)} = \frac{k_d}{1 - \frac{r_{i_large}}{r_d} + \left(\frac{r_{i_large}}{r_d}\right)\left(\frac{k_d}{k}\right)} = \frac{k}{1} \quad \text{(a)}$$

However, if there is formation damage to a depth of $r_{i_small}$, then the ratio of $k_{app}$(large)/$k_{app}$(small) would be shown by the following example:

$$\frac{k_{app}(\text{large_}id)}{k_{app}(\text{small_}id)} = \frac{1 - \frac{r_{i_small}}{r_d} + \left(\frac{r_{i_small}}{r_d}\right)\left(\frac{k_d}{k}\right)}{1 - \frac{r_{i_large}}{r_d} + \left(\frac{r_{i_large}}{r_d}\right)\left(\frac{k_d}{k}\right)} \quad \text{(b)}$$

When this relationship is evaluated for $r_{i_small}=0.5r_{i_large}$, and $r_d=1.1r_{i_large}$, and $k_d=0.1k$, the ratio is:

$$\frac{k_{app}(\text{large_}id)}{k_{app}(\text{small_}id)} = \frac{.59}{.18} = 3.25 \quad \text{(c)}$$

Thus, for the numerical example illustrated in (a–c) above the apparent permeability would increase by a factor of 3.25 when the diameter of the packer-snorkle interior diameter is increased by a factor of two.

The concept disclosed by the invention can be adapted to core measuring devices such as those using a probe or minipermeameter. Either or both of the inner or outer internal diameters can be selectively modified to acquire different measurements. Although the order of analysis can be varied, a preferred embodiment of the invention investigates the larger rock surface area first before an internal, smaller rock surface area is investigated. The sequence reduces variables potentially induced by seating and reseating packing elements on probes, and removes the mud cake in one step as previously discussed.

The orientation and shape of the invention can be adjusted to investigate variations in an anistropic rock formation. Separate probes can be oriented in different spatial relationships so that the resulting measurements can be compared to evaluate permeability in different directions. For example, a first probe could encompass a relatively large first surface area, and second and third smaller probes could encompass second and third surface areas within the first surface area. The first and second surface areas, or the second and third surface areas could be oriented vertically, horizontally or in another orientation relative to the other, inside or outside of the first surface area, or could completely or partially overlap. The orientation, configuration and placement of multiple probes will depend on the rock composition and reservoir lithology.

In addition to reservoir drawdown procedures described, differences in fluid injected build-up rate can be monitored by the present invention. By using injection probes of different internal bore sizes, an analysis of rock permeability and formation damage can be performed. For this reason, the invention is applicable to permeameters as well as formation test tools and injection tests with formation test tools.

The invention provides an accurate and economic apparatus and method for assessing damage to a rock surface in a wellbore or at the surface. The total measurement time can be completed within a few minutes, and the buildup time for pressure injection can be performed within seconds for permeabilities of hundreds of milliDarcies and within minutes for permeabilities less than 0.1 millidarcies. Consequently, numerous measurements can be made economically with different diameter probes, different orientations, and different borehole locations. The invention permits an assessment of formation damage before casing is set in a borehole, or before other costly completion procedures are performed.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for evaluating damage proximate to a rock surface, comprising:

a housing;

a probe engaged with said housing and having a hollow contact end for sealing engagement with the rock surface to enclose a first interior volume and to define a discrete first surface area on the rock surface, wherein said hollow contact end is areally variable to define a discrete second surface area on the rock surface, which is smaller than said first surface area defined by said probe, and to define a second interior volume in contact with said second surface area;

a device for selectively changing the pressure within said first interior volume and within said second interior volume; and a sensor for monitoring changes within said first interior volume after said device has changed the pressure in contact with said first surface area, and for monitoring changes within said second interior volume after said device has changed the pressure in contact with said second surface area.

2. An apparatus as recited in claim 1, wherein said probe contacts the rock surface in a geologic formation.

3. An apparatus as recited in claim 1, wherein said probe contacts the rock surface of a core sample from a geologic formation.

4. An apparatus as recited in claim 1, wherein said first surface area defined by said probe contact end overlaps said second surface area defined by said probe contact end.

5. An apparatus as recited in claim 1, wherein said pressure changing device selectively reduces the pressure within said first and second interior volumes.

6. An apparatus as recited in claim 5, wherein said sensor detects pressure changes within said first and second interior volumes.

7. An apparatus as recited in claim 1, wherein said pressure changing device selectively increases the pressure within said first and second interior volumes by moving a fluid into said first and second interior volumes.

8. An apparatus as recited in claim 1, wherein said first and second surface area perimeters define concentric circles on said rock surface.

9. An apparatus as recited in claim 1, wherein said first surface area is substantially shaped as a rectangle.

10. An apparatus as recited in claim 1, wherein said first surface area comprises an elongated shape.

11. An apparatus as recited in claim 10, wherein said second surface area comprises an elongated shape orthogonal to said first surface area.

12. An apparatus as recited in claim 1, wherein said probe comprises a single element having an adjustable contact end for initially defining said first surface area and for selectively defining said second surface area.

13. An apparatus for evaluating rock formation damage proximate to a borehole wall surface, comprising;

a housing for insertion into the borehole;

an areally variable probe engaged with said housing and having a hollow contact end for sealing engagement with the borehole wall surface, wherein said contact end hollow in contact with the borehole wall surface defines the perimeter of a first surface area;

a first interior volume in contact with the hollow contact end of said probe and with said first surface area;

a means for varying sad probe for sealing engagement with the borehole wall surface to define the perimeter of a second surface area proximate to and smaller than said first surface area;

a second interior volume in contact with said second surface area;

a device for selectively changing the pressure within said first interior volume and within said second interior volume; and a sensor for monitoring pressure changes within said first interior volume after said deice has changed the pressure in contact with said first surface area, and for monitoring changes within said second interior volume after said device has changed the pressure in contact with said second surface area.

14. An apparatus as recited in claim 13, wherein said second surface area is smaller than and is contained within said first surface area.

15. An apparatus as recited in claim 13, wherein said pressure changing device selectively reduces the pressure within said first and second interior volumes.

16. An apparatus as recited in claim 13, wherein said sensor detects pressure increases within said first and second interior volumes.

17. An apparatus as recited in claim 13, wherein said pressure changing device selectively increases the pressure within said first and second interior volumes by moving a fluid into said first and second interior volumes.

18. An apparatus as recited in claim 13, wherein said first and second surface areas have the same geometric shape.

19. An apparatus as recited in claim 13, wherein the said first surface area is at least twice as large as said second surface area.

20. An apparatus as recited in claim 13, wherein said pressure changing device changes the pressure within said first and second volumes at a rate slow enough to preclude precipitation and phase separation of fluid within the borehole wall.

21. An apparatus as recited in claim 13, wherein said pressure device comprises a pump capable of increasing and of decreasing the pressure within said first interior volume and within said second interior volume.

22. An apparatus as recited in claim 13, wherein said apparatus comprises a formation testing tool.

23. An apparatus as recited in claim 13, wherein said apparatus comprises a permeameter.

24. A method for evaluating damage proximate to a rock surface, comprising the steps of:

positioning a housing proximate to the rock surface;

moving a hollow, areally variable probe until said probe sealingly contacts the rock surface to enclose a first interior volume and to define a first surface area on the rock surface;

selectively changing the pressure within said first interior volume to modify the pressure in contact with said first surface area;

operating a sensor to monitor changes within said first interior volume;

varying said probe until said probe sealingly contacts the rock surface to enclose a second interior volume and to define a second surface area on the rock surface proximate to said first surface area add having a different size than the first surface area;

selectively changing the pressure within said second interior volume to modify the pressure in contact with said second surface area; and operating a sensor to monitor changes within said second interior volume.

25. A method as recited in claim 24, further comprising the step of positioning said housing adjacent to the rock surface forming a borehole.

26. A method as recited in claim 24, further comprising the step of positioning said housing adjacent to the rock surface of a core sample removed from a borehole.

27. A method as recited in claim 24, further comprising the step of monitoring pressure changes in the first and second interior volumes.

28. A method as recited in claim 24, wherein a sensor monitors pressure changes within said first interior volume, and wherein a sensor monitors pressure changes within said second interior volume.

* * * * *